US007514874B2

(12) United States Patent
Mucklejohn et al.

(10) Patent No.: US 7,514,874 B2
(45) Date of Patent: Apr. 7, 2009

(54) CERAMIC METAL HALIDE LAMP WITH SPECIFIC HALIDE DOSAGE TO MERCURY WEIGHT RATIO

(75) Inventors: Stuart Albert Mucklejohn, Wigston Magna (GB); Zoltan Koltai, Budapest (HU)

(73) Assignee: General Electric Company, Schnectady, NY (US)

( * ) Notice: Subject to any disclaimer, the term of this patent is extended or adjusted under 35 U.S.C. 154(b) by 475 days.

(21) Appl. No.: 11/205,379

(22) Filed: Aug. 17, 2005

(65) Prior Publication Data

US 2006/0290286 A1 Dec. 28, 2006

(30) Foreign Application Priority Data

Nov. 10, 2004 (GB) ..... 0424840.7

(51) Int. Cl.
*H01J 61/16* (2006.01)

(52) U.S. Cl. ..... 313/643

(58) Field of Classification Search ..... 313/643, 313/639–642, 637
See application file for complete search history.

(56) References Cited

U.S. PATENT DOCUMENTS

| | | | | |
|---|---|---|---|---|
| 3,906,274 | A | 9/1975 | Silver et al. | |
| 4,978,884 | A | 12/1990 | Van Vliet et al. | |
| 6,501,220 | B1 | 12/2002 | Lambrechts et al. | |
| 6,731,068 | B2 * | 5/2004 | Dakin et al. | 313/640 |
| 6,756,721 | B2 * | 6/2004 | Higashi et al. | 313/17 |
| 2003/0117075 | A1 | 6/2003 | Kramer | |
| 2004/0189212 | A1 | 9/2004 | Ashida et al. | |

FOREIGN PATENT DOCUMENTS

| | | | |
|---|---|---|---|
| EP | 0 215 524 | A1 | 3/1987 |
| GB | 1008339 | A | 10/1965 |
| GB | 1110018 | A | 4/1968 |
| GB | 2032682 | | 5/1980 |
| GB | 2062956 | | 5/1981 |
| GB | 2211985 | A | 7/1989 |
| GB | 2216334 | A | 10/1989 |
| WO | WO 93/18541 | | 9/1993 |

OTHER PUBLICATIONS

PCT/US2005/039566—Notification of Transmittal of the International Search Report and the Written Opinion of the International Searching Authority, or the Declaration; mailed Mar. 29, 2006; 8 pages.

* cited by examiner

*Primary Examiner*—Toan Ton
*Assistant Examiner*—Hana A Sanei
(74) *Attorney, Agent, or Firm*—Fay Sharpe LLP

(57) ABSTRACT

A ceramic metal halide lamp wherein the halide dose includes the following component ranges in mol/cm$^3$: NaI: 1.84×10-5 to 2.33×10-5, LnI3: 5.20×10-6 to 6.60×10-6, TlI: 1.76×10-7 to 2.23×10-7, wherein Ln are lanthanide elements, and further includes a halide dosage weight of between 0.40 to 0.77.

10 Claims, 1 Drawing Sheet

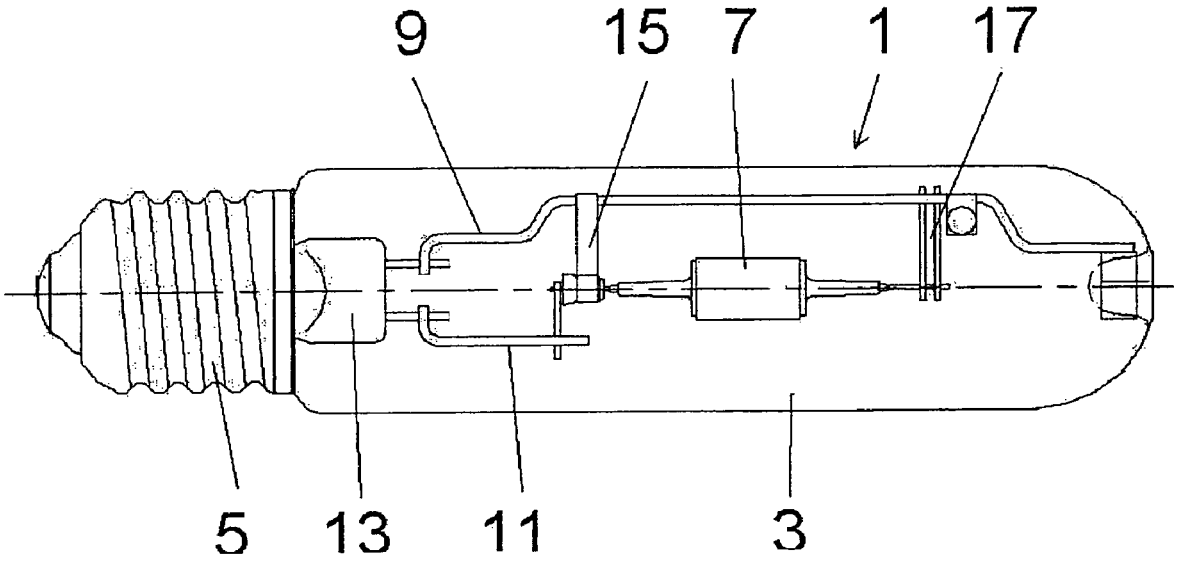
9
15
7
1
17
5
13
11
3

CERAMIC METAL HALIDE LAMP WITH SPECIFIC HALIDE DOSAGE TO MERCURY WEIGHT RATIO

This invention relates to ceramic metal halide lamps and particularly but not exclusively to lamps for use in street and like ground illumination lighting.

The dominant wear out mechanism for metal halide discharge lamps with ceramic arctubes is corrosion of the polycrystalline alumina (PCA) wall. The metal halide dosed into the arctube transports PCA from one area to another during lamp operation. This transport of material eventually results either in a small hole in the wall of the arctube and hence lamp failure or the wall becomes so thin that it cracks under thermal stress (usually when the lamp is switched on or off). PCA transport is more severe in vertically operated lamps than in horizontally operated lamps. The rate of PCA transport increases with increasing metal halide dose weight. Thus, as halide dose weight increases, lamp life decreases.

However, previous lamp designs have used a higher halide dose to provide colour control so that all lamps can be made with the same colour output, such colour control being necessary for general illumination purposes such as illuminated advertising displays but the increase in halide dosage results in a lower luminous output and a shorter lamp life.

The present invention seeks to provide a ceramic metal halide lamp with increased life, high luminous output system efficiency. It is desirable that the lamp should be operated in either horizontal or vertical orientation.

According to the invention, there is provided a ceramic metal halide discharge lamp having a halide dosage weight to mercury weight of between 0.40 to 0.77.

Preferably the halide dosage weight to mercury weight is between 0.53 to 0.68.

The halide dose may contain the following component ranges in mol/cm$^3$:

| | |
|---|---|
| NaI | 1.84E-05 to 2.33E-05 |
| $LnI_3$ | 5.20E-06 to 6.60E-06 |
| TlI | 1.76E-07 to 2.23E-07 |

wherein Ln are lanthanide elements.

The lanthanide halides may include $DyI_3$ which may have a range of 4.59E-06 to 5.81E-06 mol/cm$^3$.

The lanthanide halides may include $CeI_3$ which may have a range of 6.14E-07 to 7.77E-07 mol/cm$^3$.

The lamp may be rated at 150 watts and the halide dose may contain the following components in mol/cm$^3$:

| | |
|---|---|
| NaI | 2.012E-05 |
| $DyI_3$ | 5.018E-06 |
| TlI | 1.930E-06 |
| $CeI_3$ | 6.720E-07. |

BRIEF DESCRIPTION OF THE DRAWING

The invention will now be described in greater detail, by way of example, with reference to the drawings, the single FIGURE of which shows a side view of the type of lamp with which the invention is used.

DETAILED DESCRIPTION OF THE INVENTION

This lamp 1 comprises an outer envelope 3 attached (in this case) to an Edison screw fitting 5. Within the outer envelope 3 is located an arc tube 7 which is carried by a pair of conductive members 9 and 11 which extend from a pinch 13 and have supports 15 and 17 for the arc tube 7 while also providing the electrical feed to the electrodes (not shown) situated in the arc tube 7.

The arc tube 7 is provided with a filling of mercury dosed with suitable halides to provide the desired characteristics of the discharge. The outer envelope is either evacuated or filled with a low pressure of an inert gas It will be understood that the construction of the lamp, as described above, plays no part in the invention itself. The invention resides in the dosages which will provide the desired longevity, luminance and efficiency.

The present embodiment is particularly although not exclusively concerned with lamps which are rated at 150 watts as lamps of this wattage are particularly useful in street and like lighting both as original equipment and as replacements for existing lamps such as sodium vapour lamps. Ceramic metal halide discharge lamps would have certain advantages over sodium vapour lamps if they could produce an good luminous output of acceptable colour as they produce a whiter light which is better for night vision than the yellow colour produced by the sodium vapour. One of the features that the inventors have discovered is that the colour control needed for lamps used for street and roadway type lighting is less stringent than that required for interior display lighting. While in display lighting, adjacent lamps are in close proximity to each other and therefore any change in colour between adjacent lamps immediately becomes obvious with a deleterious effect on the display concerned, with the spacing used in street lighting and the ambient circumstances means that differences in the colour of adjacent lamps is less critical. The inventors have also discovered that, for street lighting and similar purposes, a much lower a halide dose can be used than was previously believed possible and this has resulted, surprisingly, in a significantly higher luminous output and a significantly increased lamp life while providing an acceptable colour control.

Thus, in the case of an embodiment of a 150 watt lamp, the challenges which are to be met are the provision of a: low halide weight dose giving potential long lamp life; a high luminous output, typically greater than 14500 lumens with a lamp efficacy of greater than 96 lumens per watt (LPW) and a system efficacy of greater than 90 LPW. With operation at 71 per cent of rated system power (115 W) this would give 9586 lumens, 83 lumens per watt system efficacy; and an increase in colour temperature of 336K. The lamp is to be designed so that it can be operated vertically or horizontally.

In accordance with this embodiment, the arctube contains a low halide dose weight of 7 mg whereas all other arctubes of this rating, which employ the same ceramic component, have dose weight of at least 8 mg, typically 10 to 14 mg.

Below are set out in tabular form, the parameters which are employed in this invention and particularly with regard to the 150 waft embodiment.

1. Halide mixture used specifically in an example of a 150 watt lamp:

| component | wt fraction | mol/cm$^3$ |
|---|---|---|
| NaI | 0.448 | 2.012E-05 |
| $DyI_3$ | 0.405 | 5.018E-06 |
| TlI | 0.095 | 1.930E-06 |
| $CeI_3$ | 0.052 | 6.720E-07 |

weight of above mixture used=7.0 mg weight of mercury used=11.5 mg weight ratio of halide to mercury=0.61 internal volume of the arc chamber=1.04 cm3

2. Preffered halide concentration range for 150 watt lamps in general

| component | mol/cm$^3$ range |
|---|---|
| NaI | 1.84E-05 to 2.33E-05 |
| $DyI_3$ | 4.59E-06 to 5.81E-06 |
| TlI | 1.76E-06 to 2.23E-06 |
| $CeI_3$ | 6.14E-07 to 7.77E-07 |

3. Preffered halide weight range for 150 watt lamps in general

| | |
|---|---|
| total wt/mg | 5.8 to 8.2 |
| mg/cm$^3$ | 5.58 to 7.88 |

4. Preferred mercury weight range for 150 watt lamps in general

| | |
|---|---|
| total/mg | 11.0 to 12.0 |
| mg/cm3 | 10.58 to 11.54 |

5. Preffered halide to mercury weight ratio for 150 watt lamps in general

| | |
|---|---|
| halide/mercury | 0.53 to 0.68 |

6. General halide concentration range for all lamps falling within the invention and containing NaI+TlI+$LnI_3$, where Ln=lanthanide elements

| component | mol/cm$^3$ range |
|---|---|
| NaI | 1.84E-05 to 2.33E-05 |
| $LnI_3$ | 5.20E-06 to 6.60E-06 |
| TlI | 1.76E-07 to 2.23E-07 |

7. Preffered halide weight range for all lamps falling within the invention

| | |
|---|---|
| total/mg | 4.0 to 10.0 |
| mg/cm$^3$ | 3.85 to 9.62 |

8. Preferred mercury weight range for all lamps falling within the invention

| | |
|---|---|
| total/mg | 10.0 to 13.0 |
| mg/cm$^3$ | 9.62 to 12.50 |

9. General halide to mercury weight ratio for all lamps falling within the invention

| | |
|---|---|
| halide/mercury | 0.40 to 0.77 |

It will be appreciated that while the above has generally been dealing with 150 watt lamps, the invention is equally applicable to lamps of other wattages, with the ratios and concentrations set out above. It will also be understood that where individual amounts rather than ratios or concentrations are given, these only apply to the specific lamps quoted.

The low dose weight & high mercury weight presented in this disclosure give the ideal balance between spectral power distribution, efficacy, response to operation at reduced power (dimming) and life for light sources used for street lighting and road lighting. The lamp, however, is suited to other applications as it can be operated in vertical or horizontal positions. The dose weight can be translated into concentrations (molar or weight) per unit volume in the arctube.

The lamp has been designed to give its optimum performance when operated on an electronic ballast. Electronic ballasts offer some benefits over electromagnetic ballasts for the operation of high intensity discharge lamps, these include the advantage of constant power regulation over the life of the lamp despite the increasing lamp voltage.

The invention claimed is:

1. A ceramic metal halide lamp wherein the halide dose comprises the following component ranges in mol/cm$^3$:

| | |
|---|---|
| NaI | $1.84 \times 10^{-5}$ to $2.33 \times 10^{-5}$ |
| $LnI_3$ | $5.20 \times 10^{-6}$ to $6.60 \times 10^{-6}$ |
| TlI | $1.76 \times 10^{-7}$ to $2.23 \times 10^{-7}$ |

Wherein Ln are lanthanide elements, and further comprising a halide dosage weight to mercury weight of between 0.40 to 0.77.

2. A lamp as claimed in claim 1 wherein the halide dosage weight to mercury weight is between 0.53 to 0.68.

3. A lamp as claimed in claim 1, wherein the lanthanide halides include $DyI_3$.

4. A lamp as claimed in claim 3, wherein the component range of $DyI_3$ is $4.59\times10^{-6}$ to $5.81\times10^{-6}$ mol/cm$^3$.

5. A lamp as claimed in claim 4 wherein the lanthanide halides include $CeI_3$.

6. A lamp as claimed in claim 3 wherein the lanthanide halides include $CeI_3$.

7. A lamp as claimed in claim 1 wherein the lanthanide halides include $CeI_3$.

8. A lamp as claimed in claim 7, wherein the component range of $CeI_3$ is $6.14\times10^{-7}$ to $7.77\times10^{-7}$ mol/cm$^3$.

9. A lamp as claimed in claim 1, wherein the lamp is rated at 150 watts.

10. A ceramic metal halide lamp rated at 150 wtts having a halide dosage weight to mercury weight of between 0.40 to 0.77, wherein the halide dose comprises the following component ranges in mol/cm$^3$:

| | |
|---|---|
| NaI | $2.012 \times 10^{-5}$ |
| $DyI_3$ | $5.018 \times 10^{-6}$ |
| TlI | $1.930 \times 10^{-6}$ |
| $CeI_3$ | $6.720 \times 10^{-7}$. |

* * * * *